US006711455B1

(12) United States Patent
Holloway et al.

(10) Patent No.: US 6,711,455 B1
(45) Date of Patent: Mar. 23, 2004

(54) METHOD FOR CUSTOM FITTING OF APPAREL

(75) Inventors: Robert Gordon Ernest Holloway, Novato, CA (US); Jeffrey Aldredge Luhnow, Berkeley, CA (US); Steven Carl Heard, Alameda, CA (US); Philip J. Ramsey, Brookline, NH (US)

(73) Assignee: Archetype Solutions, Inc., Emeryville, CA (US)

( * ) Notice: Subject to any disclaimer, the term of this patent is extended or adjusted under 35 U.S.C. 154(b) by 275 days.

(21) Appl. No.: 09/909,930

(22) Filed: Jul. 20, 2001

(51) Int. Cl.[7] ..... G06F 19/00

(52) U.S. Cl. ..... 700/132; 700/131; 700/303; 702/155; 702/166; 702/167

(58) Field of Search ..... 700/131, 132, 700/303; 702/150–153, 155, 156, 158, 166, 167; 703/2; 33/12, 14, 15

(56) References Cited

U.S. PATENT DOCUMENTS

| | | | | |
|---|---|---|---|---|
| 4,136,452 | A | 1/1979 | McMillan | |
| 4,149,246 | A | 4/1979 | Goldman | |
| 4,598,376 | A | 7/1986 | Burton et al. | |
| 4,868,990 | A | 9/1989 | Steinberg | |
| 4,894,918 | A | 1/1990 | Huang | |
| 4,916,624 | A | 4/1990 | Collins et al. | |
| 4,916,634 | A | 4/1990 | Collins et al. | |
| 4,926,344 | A | 5/1990 | Collins et al. | |
| 5,163,006 | A | 11/1992 | Deziel | |
| 5,163,007 | A | 11/1992 | Slilaty | |
| 5,548,519 | A | 8/1996 | Park et al. | |
| 5,680,314 | A | 10/1997 | Patterson et al. | |
| 5,768,135 | A | 6/1998 | Park et al. | |
| 5,956,525 | A | 9/1999 | Minsky | |
| 6,353,770 | B1 * | 3/2002 | Ramsey et al. | 700/131 |
| 6,490,534 | B1 * | 12/2002 | Pfister | 702/94 |
| 6,546,309 | B1 * | 4/2003 | Gazzuolo | 700/132 |

OTHER PUBLICATIONS

International Search Report, Sep. 6, 2002 (PCT).

Roediger et al., 3D–Visualization of Garments, Proceedings of the Computer Graphics International, Jun. 1998, pp. 396–400.

* cited by examiner

*Primary Examiner*—Anil Khatri
*Assistant Examiner*—Crystal J. Barnes
(74) *Attorney, Agent, or Firm*—Milbank, Tweed, Hadley & McCloy LLP

(57) ABSTRACT

The present invention is directed to a method for custom fitting an article to a human being having the steps of defining a first set of human body dimensions to be reported by the human being, defining a second set of human body dimensions to be inferred from said first set of human body dimensions, providing a first mathematical model relating said second set of human body dimensions to said first set of human body dimensions, wherein said mathematical model has been generated by statistical analysis of a human anthropometric database, obtaining a first set of values of said first set of body dimensions by report of the human being, computing a second set of values of said second set of human body dimensions from said first set of values of said first set of human body dimensions by using said first mathematical model, defining a set of article dimensions, providing a second mathematical model relating said article dimensions to said first set of human body dimensions and said second set of human body dimensions, computing a third set of values of said set of article dimensions from said first set of values of said first set of human body dimensions and said second set of values of said second set of human body dimensions by using said second mathematical model.

25 Claims, No Drawings

METHOD FOR CUSTOM FITTING OF APPAREL

FIELD OF THE INVENTION

This invention relates to custom manufacturing of apparel and more particularly to a method of calculating garment dimensions and production specifications based on information captured from or about the individual for whom the garment is to be made. More specifically, this invention relates to the use of a publicly-available anthropometric database for the statistical derivation of the parameters of a mathematical model of the relationship between reported and unreported human body dimensions. This invention also relates to the calculation of the dimensions of a garment based, in part, upon the human body dimensions calculated by application of the aforementioned mathematical model.

BACKGROUND OF THE INVENTION

Matching apparel consumers with garments that have all the desired properties, features, and fit is one of the biggest problems that apparel retailers face. The vast majority of apparel retailers struggle with managing the tradeoff between carrying a larger assortment of products and paying the high costs of carrying large amounts of inventory. A company choosing to offer a large assortment of products, product features or variations, and sizes quickly finds the costs of inventory, inventory handling costs, and infrastructure (e.g., distribution centers) become prohibitively large as the number of stock keeping units (SKUs) increases. On the other hand, a company with a more limited assortment will find that consumers either can't find the product or size they desire, or choose a product that often they are not satisfied with, and end up returning the garment. The combined cost associated with inventory and merchandise returns represents a significant portion of the overall costs for apparel retailers, especially those who sell through direct channels such as the Internet, TV, or mail. The lost revenue opportunity for apparel retailers of all types, including store based retailers, associated with not having the correct size or product in stock can easily make the difference between a struggling and successful company.

Those consumers who find an apparel product in their size are often times settling for the best available option, rather than getting a garment that fits them properly. A survey cited in U.S. Pat. No. 5,548,519, issued to Sung K. Park on Aug. 20, 1996, for an apparatus and method for custom apparel manufacturing, found that the percentage of the population that is correctly fitted by an available standard-sized article of clothing without any alteration is only two percent.

There are two fundamentally different approaches to helping apparel consumers find garments that best meet their needs. The first involves gathering or capturing information about a consumer and using that information to recommend particular brands, products, and sizes that are likely to fit or match a consumer's tastes. The benefit of this approach is that it theoretically increases the probability that a consumer will find the best available standard product. The drawback is that this approach doesn't solve the assortment-inventory tradeoff described above, nor does it resolve the issue of failure to achieve proper fit without further garment alteration.

The second approach involves custom making of apparel garments for consumers after preference and sizing information has been captured. The apparatus and method disclosed in U.S. Pat. No. 5,548,519 is an example of this approach. This approach involves having consumers try on several products of predetermined dimensions until the consumer approves the fit and purchases the garment. At that point, the information captured during the try-on session is reported to a manufacturing system that begins the process of making the garment. Another approach, described in U.S. Pat. No. 5,956,525, issued to Jacob Minsky on Sep. 21, 1999, for a method of measuring body measurements for custom apparel manufacturing, involves the use of multiple cameras in a specially designed room, capturing height and width data about a consumer. These data are then used to manufacture the clothing.

These approaches do provide the manufacturing system with information that is useful in producing a custom garment, and will likely result in a better fitting garment than the standard sizes. Since the garments are made after the consumer order has been completed, there is less of a need for retailers to carry large amounts of finished-goods inventory. The downside of these approaches is that they require substantial involvement and time from the consumer. The majority of consumers find that shopping for apparel is not a particularly desirable activity, but rather a necessary evil. Any product that requires more involvement and more time from consumers will find limited potential in today's environment where an increasingly large number of household or personal needs can be met from a computer, a laptop, a PDA, or even a cell phone.

OBJECTS OF THE INVENTION

It is an object of the present invention to provide a system and method for capturing information about a person and using that information to determine exact specifications for an apparel product and instructions for the production of a custom apparel product. The information can be communicated remotely over the phone, using the Internet, interactive television, via mail, or through any other communication device that is used for electronic commerce such as web-enabled phones or personal digital assistants (PDAs). This information can also be communicated directly to a retailer's agent, a kiosk, or any other information capture tool in a store environment.

A consumer is asked a series of questions about themselves (or the person for whom they are purchasing the item), their preferences, desired features, and other product choices regarding the item that is being considered. It is an object of the invention to select such questions in such a way that consumers neither have to be measured by a tailor or other person, nor measure themselves, in order to complete the ordering process. It is an object of the invention to make use of the information that is captured from or on behalf of the person for whom the item is intended to serve as inputs to a set of model formulas that calculates other pieces of information needed for developing product specifications and production instructions for the manufacturing of a custom apparel product, but not provided directly by the consumer.

It is an object of the present invention to apply methods of statistical analysis to a publicly available database of human anthropometric measurements as a means of determining the numerical coefficients of the model formulas used to calculate unprovided anthropometric measurements from provided anthropometric measurements. It is also within the scope of the present invention to supplement the anthropometric measurements in the publicly available database with measurements of additional individuals.

It is an object of the present invention to provide a method of shopping for products that can be customized based on an individual person's body shape, lifestyle attributes, and product preferences which allows customers to quickly, easily and conveniently order custom apparel.

Another object of the present invention is to provide a system and method of determining necessary product specifications such as garment dimensions based upon both consumer-provided and model-derived human body measurements that provides retailers and manufacturers of these products with all the necessary dimensions and other specifications required to produce a custom apparel product. Yet another object of the present invention is to provide a method for adjusting calculated garment dimensions on the basis of consumer-selected garment fit preferences.

A further object of the present invention is to provide a method of shopping for products that can be customized based on an individual person's body shape and product preferences as a marketing and sales tool for retailers and manufacturers to provide custom apparel for consumers.

These and other features of the present invention are described in more detail in the following detailed description. The scope of the invention, however, is limited only by the claims appended hereto.

SUMMARY OF THE INVENTION

The present invention is a method for custom fitting an article to a human being having the steps of defining a first set of human body dimensions to be reported by the human being, defining a second set of human body dimensions to be inferred from said first set of human body dimensions, providing a first mathematical model relating said second set of human body dimensions to said first set of human body dimensions, wherein said mathematical model has been generated by statistical analysis of a human anthropometric database, obtaining a first set of values of said first set of body dimensions by report of the human being, computing a second set of values of said second set of human body dimensions from said first set of values of said first set of human body dimensions by using said first mathematical model, defining a set of article dimensions, providing a second mathematical model relating said article dimensions to said first set of human body dimensions and said second set of human body dimensions, computing a third set of values of said set of article dimensions from said first set of values of said first set of human body dimensions and said second set of values of said second set of human body dimensions by using said second mathematical model.

DETAILED DESCRIPTION OF THE PREFERRED AND OTHER EMBODIMENTS

There are numerous ways an apparel retailer can capture necessary information from a consumer interested in purchasing apparel, both remotely and in-store. Remotely, the interested consumer can access a retailer's web site through a computer, a PDA, a web enabled phone, interactive television, or any other electronic medium used to access the Internet. Also remotely, the interested consumer can call a retailer's customer service or ordering center, or they could send a fax or use any form of mail. In a store environment, the interested consumer could either provide the information directly to an employee of the retailer, or use any self-service device in the store such as a kiosk, Internet terminal or customer service telephone.

In a preferred embodiment, the potential consumer would log on to the retailer's web site. This web site may have a combination of standard and custom products, or may offer exclusively custom made products. The potential consumer would choose the portion of the virtual store that offers custom made products, and then select the product category in which they are interested (a pair of pants, a pair of jeans, a sweater, a skirt, a dress, a shirt, a blouse, a vest, a jacket, a coat, a pair of knickers, a pair of leggings, a jersey, a pair of shorts, a leotard, a pair of underwear, a hat, a cap, and a swimming or bathing suit). Once they have selected the product category, then they begin to make choices about the product they desire. In the case of pants, they would choose the fabric, the color, the style, whether they want cuffs, pleats, and the type of fly (zipper or button). These are some of the feature and style choices that could be available.

Once the potential consumer has made all of the feature and style choices for the product, they would provide the information needed for sizing. The information that is collected for sizing will be information that most apparel consumers know about themselves, and that can be used to either (1) directly determine desired measurements for the design of the garment pattern, or (2) estimate, either alone or in conjunction with other pieces of information, other necessary measurements for the design of the garment pattern. Consumers may also be asked to make assessments of themselves and their body shape, as well as to take simple measurements of certain of their body dimensions.

Once the information is collected from the potential consumer, a series of formulas (also referred to as a "fitting model") are used to determine the exact garment dimensions for that consumer. These formulas are developed through a detailed understanding of the human body, how the dimensions of the body relate to one another, and how those body dimensions interact to establish the required garment dimensions used as inputs for the pattern-making and garment manufacturing processes.

In the preferred embodiment, the fitting model can be subdivided into two conceptually distinct parts. The first part of the model contains formulas that relate various dimensions of the human body to one another, and are used to infer body dimensions that are not reported by the consumer from those that are reported by the consumer. In the most preferred embodiment, this first part of the model is derived by statistical analysis of the publicly available U.S. Army 1988 anthropometric survey, although in other embodiments the data in the U.S. Army database may be supplemented by body measurements of other individuals. The second part of the model calculates from the reported and inferred body dimensions the necessary input values to the garment manufacturing process—i.e., the dimensions of the garment used to determine exactly how to cut and sew the fabric to make the garment. In the most preferred embodiment, this second part of the model is derived in part from the experience of a skilled clothing designer and/or tailor.

Although not an essential part of the present invention, we note that the output of the second part of the fitting model—the calculated garment dimensions—would be used as inputs to a pattern maker (either human or automated), which would then use techniques well known to those of ordinary skill in the pattern-making arts to generate exact fabric cutting templates and sewing instructions on the basis of the calculated garment dimensions and intended style of the garment.

In order to develop the relationships between dimensions of the body which are needed for correctly sizing a garment, data may be used from both publicly available anthropometrical studies and/or private sources of data, including measuring numerous individuals and recording the information. Once the initial relationships have been defined, these can be refined and improved over time as more data become available and as feedback from consumers and test subjects is collected. In the most preferred embodiment, the U.S. Army 1988 anthropometric survey is used to derive the coefficients of a linear model that relates the values of certain body measurements that are not reported by the consumer to those that are reported by the consumer. In this most preferred embodiment, the body measurements reported by the consumer are "reported waist", "reported inseam", "weight", "height", and "shoe size". These are referred to as the independent variables of the model. In this most preferred embodiment, the body measurements to be inferred from these reported measurements are "seat" and "outseam". These are referred to as the dependent variables of the model. It is to be understood that other sets of body measurements than those of the most preferred embodiment can be used as the independent and dependent variables.

In the most preferred embodiment, the following steps are used to derive the linear equations of the model that relate the dependent variables to the independent variables. Principal components multiple linear regression analysis is the well-known statistical method used to derive the parameters of any given linear model that relates a dependent variable to a particular subset of the independent variables. As part of the process of identifying a suitable model, it is determined which of the independent variables have predictive value in inferring the dependent variable, and the coefficients of those predictive variables is also determined.

First, a relatively large number of potential models, using a variety of subsets of independent variables, and that have been derived by multiple linear regression, are tested for their predictive value using the well-known statistical technique of prediction squared error, which allows the winnowing out of the least predictive models.

Second, the more accurate, but more time-consuming and laborious, method of cross-validation is applied to the remaining models to identify the single model that has the greatest predictive power. Cross-validation takes advantage of the large number of individuals in the U.S. Army database by using only half of the individuals in the database (the "regression" half, which can be randomly chosen) as the input to the multiple linear regression for computing the model coefficients. Then, the values of the independent variables of each individual in the other ("test") half of the database are used as inputs to each potential model to calculate a predicted value for each dependent variable. The difference for each individual in the "test" half between the predicted value and the actual value of each dependent variable is then squared and summed across all of the individuals in the test half. This sum of squared errors generated through cross-validation provides an accurate measure of the relative predictive power of each of the potential models, and avoids the inaccuracies introduced when one validates a model on the same set of individuals used as inputs to the regression that was used to generate the model. The potential model that exhibits the lowest sum of squared errors in the cross-validation is thus chosen for ultimate use in predicting the unreported body measurements of consumers from their reported body measurements.

Once the unreported body measurements have been inferred from the reported body measurements on the basis of the anthropometric model, the actual garment dimensions are calculated. This is the second part of the overall fitting model. This second part of the model may be generated on the basis of the experiences of the garment designer with garment design and patternmaking, and takes into account a number of factors. These factors include adjustments to the body measurements to allow for "ease" in the garment. Ease refers to the fact that if a garment were constructed that had the exact same dimensions—waist, seat, inseam, etc.—as the body dimensions of the wearer, the garment would be "skin tight", uncomfortable, and correctly perceived as ill-fitting. In order to compensate for this, it is well known in the art to add an amount of ease to the body dimensions when calculating the garment dimensions.

In addition, the second part of the model takes into account the stated preferences of the consumer with regard to the shape and/or fit of the garment. Thus, the customer may report whether he or she desires a "close fit" or a "loose fit", and might also report whether the desired shape of the garment is to be "tapered" or "straight". These preferences are used to further adjust the garment dimensions in the appropriate way.

Also, the second part of the model may be used to compensate for systematic errors in the body dimensions that consumers report. Not surprisingly, most consumers will under-report their weight and waist size, while over-reporting their height. In part, the under-reporting of waist size results from the fact that many manufacturers of off-the-shelf pants use what is known as "vanity sizing". Off the shelf pants that are labeled as having, e.g., a 34 inch waist, may have an actual waist size of 35 to 36 inches. The under-reporting of weight and over-reporting of height stem from the well-known societal standards of physical attractiveness wherein "tall and slim" is most desirable. Regardless of the origins of any of these reporting errors, adjustments may be made to the calculated garment to dimensions to help compensate.

The second part of the model may also be used to take account of the interrelationships between various of the garment dimensions. In other words, depending on the particular value of one garment dimension, another garment dimension may need to be adjusted to keep the overall fit of the garment as required for the body dimensions of the wearer. One example of this is the relationship between "rise"—the vertical distance between the crotch and waist of a pair of pants—and inseam. As the rise increases, the inseam must correspondingly decrease, or else the distance of the cuff of the pant leg from the floor will become too short—i.e. the pants will fit "too long".

EXAMPLE 1

An example of the formulas that can be used to determine garment specifications for men's pants is described in detail below. Where indicated, these formulas were derived from the U.S. Army anthropometric database using a method as outlined above. This example is not meant to be limiting to full the scope of the invention, as many other formulas are consistent with the invention.

Algorithm #1

Inferring Male "Seat" and "Outseam" From "Reported Waist", "Reported Inseam", "Weight", "Height", and "Shoe Size"

[Unless otherwise specified, all measurements are stated in units of inches and pounds.]

(1) Body Mass Index (BMI) is calculated from Height and Weight as a matter of definition that is well known in the anthropometric arts:

$$BMI=(Weight/(Height^2))*100$$

(2) Conicity is calculated from Height, Weight, and Reported Waist as a matter of definition that is well known in the anthropometric arts:

$$Conicity=(Reported\ Waist*0.0254)/(0.109*sqrt((Weight/2.2)/(Height*0.0254)))$$

(3) Chest is calculated from Weight and Height using a standard formula well-known in the garment tailoring arts that embodies a numerical relationship between chest, weight, and height:

Chest=35.625+(Weight/8−Height/4)

(4) Foot Length is calculated from Shoe Size (American male sizing system) using a standard formula well-known in the shoe industry:

Foot Length=7.29+(Shoe Size*0.338)

(5) Seat is calculated from Height, Weight, Chest, BMI, Conicity, and Foot Length, using a linear model derived from the U.S. Army anthropometric database of male body measurements using the method described above:

Seat=−2.85+0.36*Height+0.015*Weight−0.19*Chest+5.01*BMI+3.58*Conicity−0.055*Foot Length The coefficients of this linear model can also be expressed in terms of the various confidence intervals within which the coefficients lie, as enumerated in the table below.

| Term | Estimate | Std Error | Lower 99% | Upper 99% | Lower 95% | Upper 95% |
|---|---|---|---|---|---|---|
| Intercept | −2.8526 | 3.6686 | −12.3125 | 6.6072 | −10.0478 | 4.3426 |
| Ht" | 0.3563 | 0.0534 | 0.2186 | 0.4940 | 0.2516 | 0.4611 |
| Wt lbs | 0.0155 | 0.0106 | −0.0117 | 0.0427 | −0.0052 | 0.0362 |
| Chest" | −0.1923 | 0.0150 | −0.2309 | −0.1536 | −0.2217 | −0.1629 |
| BMI | 5.0103 | 0.5116 | 3.6912 | 6.3294 | 4.0070 | 6.0136 |
| Conicity | 3.5781 | 0.3349 | 2.7145 | 4.4417 | 2.9213 | 4.2350 |
| Foot Length | −0.0550 | 0.0174 | −0.0998 | −0.0101 | −0.0891 | −0.0208 |

| Term | Lower 90% | Upper 90% | Lower 80% | Upper 80% | Lower 50% | Upper 50% |
|---|---|---|---|---|---|---|
| Intercept | −8.8901 | 3.1848 | −6.6560 | 0.9507 | −3.3137 | −2.3916 |
| Ht" | 0.2684 | 0.4442 | 0.3009 | 0.4117 | 0.3496 | 0.3630 |
| Wt lbs | −0.0019 | 0.0329 | 0.0046 | 0.0264 | 0.0142 | 0.0168 |
| Chest" | −0.2170 | −0.1676 | −0.2078 | −0.1767 | −0.1942 | −0.1904 |
| BMI | 4.1684 | 5.8522 | 4.4799 | 5.5407 | 4.9460 | 5.0746 |
| Conicity | 3.0269 | 4.1293 | 3.2309 | 3.9253 | 3.5360 | 3.6202 |
| Foot Length | −0.0836 | −0.0263 | −0.0730 | −0.0369 | −0.0572 | −0.0528 |

For example, the likelihood is 99% that the truly most predictive coefficient of the Weight term lies between −0.012 and 0.043, while the likelihood is 80% that the truly most predictive coefficient of the Weight term lies between 0.005 and 0.026. Seat models whose coefficients lie within any of the enumerated confidence intervals are consistent with the present invention.

(6) Outseam is calculated from Height, Chest, BMI, Conicity, and Foot Length, using a linear model derived from the U.S. Army anthropometric database of male body measurements using the method described above:

Outseam=−0.63+0.64*Height+0.048*Chest−0.45*BMI−3.64*Conicity+0.14*Foot Length

The coefficients of this linear model can also be expressed in terms of the various confidence intervals within which the coefficients lie, as enumerated in the table below.

| Term | Estimate | Std Error | Lower 99% | Upper 99% | Lower 95% | Upper 95% |
|---|---|---|---|---|---|---|
| Intercept | −0.6284 | 0.6094 | −2.1998 | 0.9430 | −1.8236 | 0.5668 |
| Ht" | 0.6395 | 0.0113 | 0.6105 | 0.6686 | 0.6174 | 0.6616 |
| Chest" | 0.0480 | 0.0152 | 0.0089 | 0.0871 | 0.0183 | 0.0778 |
| BMI | −0.4465 | 0.0924 | −0.6848 | −0.2083 | −0.6277 | −0.2654 |
| Conicity | −3.6434 | 0.3389 | −4.5172 | −2.7696 | −4.3080 | −2.9788 |
| Foot Length | 0.1428 | 0.0176 | 0.0974 | 0.1882 | 0.1083 | 0.1773 |

| Term | Lower 90% | Upper 90% | Lower 80% | Upper 80% | Lower 50% | Upper 50% |
|---|---|---|---|---|---|---|
| Intercept | −1.6313 | 0.3745 | −1.2602 | 0.0034 | −0.7050 | −0.5518 |
| Ht" | 0.6210 | 0.6581 | 0.6278 | 0.6512 | 0.6381 | 0.6409 |
| Chest" | 0.0231 | 0.0730 | 0.0323 | 0.0638 | 0.0461 | 0.0499 |
| BMI | −0.5986 | −0.2945 | −0.5423 | −0.3508 | −0.4582 | −0.4349 |
| Conicity | −4.2011 | −3.0857 | −3.9947 | −3.2921 | −3.6860 | −3.6008 |
| Foot Length | 0.1138 | 0.1717 | 0.1245 | 0.1610 | 0.1406 | 0.1450 |

For example, the likelihood is 99% that the truly most predictive coefficient of the Conicity term lies between −4.5172 and −2.7696, while the likelihood is 80% that the truly most predictive coefficient of the Conicity term lies between −3.9947 and −3.2921. Outseam models whose coefficients lie within any of the enumerated confidence intervals are consistent with the present invention.

Algorithm #2

Calculating Garment Dimensions From Body Dimensions Calculated By Algorithm #1 and Stated Consumer Preference The consumer reports whether he would prefer the fit of the pants to provide a "Little Room", a "Close Fit", or be "Loose Fitting".

[The "ROUND" operator applies ordinary nearest integer rounding. The "ROUNDUPEIGHTH" operator rounds up to the nearest eighth of an inch.]

(1) Garment Waist is calculated from Reported Waist:

When Reported Waist<36, Garment Waist=Reported Waist+1;

Otherwise, Garment Waist=Reported Waist+1.5

(2) Seat-Waist Differential is calculated from Seat and Garment Waist: Differential=ROUND(Seat+4.5)−Garment Waist (3) Garment Seat is calculated from Differential, Garment Waist, Seat, and consumer fit preference:

(a) If Fit Preference is "Little Room":

When Differential<5, Garment Seat=ROUND (Garment Waist+5);

When Differential>11, Garment Seat=ROUND (Garment Waist+11);

Otherwise, Garment Seat=ROUND(Seat+4.5)

[The Garment Seat computed for a Fit Preference of "Little Room" is defined as "Little Room Garment Seat".]

(b) If Fit Preference is "Close Fit":

When Differential<6, Garment Seat=ROUND (Garment Waist+5);

Otherwise, Garment Seat=Little Room Garment Seat−1

(c) If Fit Preference is "Loose Fitting":

When Differential>9, Garment Seat=ROUND (Garment Waist+11);

Otherwise, Garment Seat=Little Room Garment Seat+2

(4) Seat Shape is defined by the input of the consumer, who chooses either FLAT, PROMINENT, or AVERAGE.

(5) Rise is defined by the input of the consumer, who chooses either SHORT, LONG, or AVERAGE.

(6) Garment Inseam is calculated from Reported Inseam and Rise:

When Rise SHORT, Garment Inseam Reported Inseam;

When Rise=LONG, Garment Inseam=Reported Inseam−1;

Otherwise, Garment Inseam=Reported Inseam−0.5

(7) Leg Bottom Opening Circumference (Bottom Opening) is calculated from consumer fit preference and Foot Length:

When Fit Preference=Close Fit, Bottom Opening=3.14*Foot Length*0.50;

When Fit Preference=Little Room, Bottom Opening=3.14*Fott Length*0.54;

When Fit Preference=Loose Fitting, Bottom Opening=3.14*Foot Length*0.57

The garment dimensions calculated and derived using algorithm #2, as just described, may be used as inputs to either a human or automated pattern maker, thus enabling the ultimate cutting and sewing necessary to produce the desired custom fitted garment. The formulas described in algorithms #1 and #2 in Example 1 for custom men's pants do not limit the broadest scope of the present invention, and are meant to provide an exemplary embodiment of the invention. The present invention may be used to provide custom fitted garments either for men or for women, and may be used to provide not only pants but shirts, jackets, skirts, vests, and any other article of apparel. Indeed, the present invention in its broadest scope should be considered applicable to the custom design of any manufactured article that is most desirable when "fit" to the body dimensions of the human being for whom the article is intended. This would include, but is not limited to, chairs, automobile seats, airplane pilot seats, sporting goods of various types, and other articles.

It is also to be understood that it is within the scope of the present invention to make use of feedback from the consumer concerning the results of the custom fitting method to modify either or both of the fitting algorithms to result in improved fit of future garments. This may occur in two ways. First, reports from numerous customers about the fit of the custom garments designed using the present invention may be aggregated and subject to statistical analysis in order to generate corrections to the values of the coefficients of the general mathematical model used to relate unreported to reported body dimensions, or to generate corrections to the algorithm used to calculate garment dimensions from body dimensions. Second, reports from a particular customer concerning the fit of his or her custom garment may be used to generate a set of corrections to the body and/or garment dimensions for that customer so as to improve the fit of the next garment ordered. Of course, this procedure can be performed iteratively, each time the customer reports on the fit of the last garment ordered and orders a new garment.

We claim:

1. A method for custom fitting an article to a human being comprising the steps of:

defining a first set of human body dimensions to be reported by the human being;

defining a second set of human body dimensions to be inferred from said first set of human body dimensions;

providing a first mathematical model relating said second set of human body dimensions to said first set of human body dimensions wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions; and computing a third set of values of said set of article dimensions from said first set of values of said first set of human body dimensions and said second set of values of said second set of human body dimensions by using said second mathematical model, wherein said first mathematical model comprises a linear equation of the form X=A+B*Height+C*Weight+D*Chest+E*BMI+F*Conicity+G*Foot Length, and wherein X is one of said first set of human body dimensions, A is the intercept, B is the coefficient of height, C is the coefficient of weight, D is the coefficient of chest, E is the coefficient of body mass index, F is the coefficient of conicity, and G is the coefficient of foot length.

2. The method of claim 1, wherein X is selected from the group consisting of seat and outseam.

3. The method of claim 1, wherein X is seat.

4. The method of claim 1, wherein X is outseam.

5. The method of claim 1, wherein X is seat, A is approximately −2.85, B is approximately 0.36, C is approximately 0.015, D is approximately −0.19, E is approximately 5.01, F is approximately 3.58, and G is approximately −0.055.

6. The method of claim 1, wherein X is seat, A is from approximately −6.65 to approximately 0.95, B is from approximately 0.30 to approximately 0.41, C is from approximately 0.0046 to approximately 0.0264, D is from approximately −0.21 to approximately −0.18, E is from approximately 4.48 to approximately 5.54, F is from approximately 3.23 to approximately 3.93, and G is from approximately −0.07 to approximately −0.04.

7. The method of claim 1, wherein X is outseam, A is approximately −0.63, B is approximately 0.64, C is approximately zero, D is approximately 0.048, E is approximately −0.45, F is approximately −3.64, and G is approximately 0.14.

8. The method of claim 1, wherein X is outseam, A is from approximately −1.26 to approximately 0.0034, B is from approximately 0.63 to approximately 0.65, C is approximately zero, D is from approximately 0.03 to approximately 0.06, E is from approximately −0.54 to approximately −0.35, F is from approximately −3.99 to approximately −3.29, and G is from approximately 0.12 to approximately 0.16.

9. A method for custom fitting an article to a human being comprising the steps of:

defining a first set of human body dimensions to be reported by the human being;

defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions;

computing a third set of values of said set of article dimensions from said first set of values of said first set of human body dimensions and said second set of values of said second set of human body dimensions by using said second mathematical model;

defining a set of consumer preferences;

obtaining the values of said consumer Preferences by report of the human being; and adjusting said second mathematical model on the basis of said consumer preferences, wherein said consumer preferences are selected from the group consisting of fit and shape.

10. The method of claim 9, wherein the values of said fit consumer preference are selected from the group consisting of a little room, a close fit, and loose fitting.

11. The method of claim 9, wherein the values of said shape consumer preference are selected from the group consisting of tapered and straight.

12. A method for custom fitting an article to a human being comprising the steps of:

defining a first set of human body dimensions to be reported by the human being, defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions; and computing a third set of values of said set of article dimensions from said first set of values of said first set of human body dimensions and said second set of values of said second set of human body dimensions by using said second mathematical model, wherein said statistical analysis comprises prediction squared error.

13. A method for custom fitting an article to a human being comprising the steps of:

defining a first set of human body dimensions to be reported by the human being;

defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions; and computing a third set of values of said set of article dimensions from said first set of values of said first set of human body dimensions and said second set of values of said second set of human body dimensions by using said second mathematical model, wherein said human anthropometric database comprises the U.S. Army 1988 anthropometric survey.

14. A method for custom fitting an article to a human being comprising the steps of:

defining a first set of human body dimensions to be reported by the human being; defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions;

computing a third set of values of said set of article dimensions from said first set of values of said first set of human body dimensions and said second set of values of said second set of human body dimensions by using said second mathematical model;

obtaining feedback on fit of the article from the human being after delivery and use of the article; and modifying at least one of said first and second mathematical models on the basis of said feedback.

15. A method for custom fitting an article to a human being comprising the steps of:

defining a first set of human body dimensions to be reported by the human being;

defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions;

computing a third set of values of said set of article dimensions from said first set of values of said first set of human body dimensions and said second set of values of said second set of human body dimensions by using said second mathematical model;

defining a data record linked to the identity of the human being;

filling said data record with said first, second, and third sets of values; and maintaining said data record.

16. A method for custom fitting an article to a human being comprising the steps of:

defining a first set of human body dimensions to be reported by the human being;

defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions;

computing a third set of values of said set of article dimensions from said first set of values of said first set of human body dimensions and said second set of values of said second set of human body dimensions by using said second mathematical model;

obtaining information by report of the human being concerning lifestyle of the human being and intended use of the article by the human being; and modifying at least one of said first and second mathematical models on the basis of said information.

17. A method for custom fitting an article to a human being comprising the steps of:

defining a first set of human body dimensions to be reported by the human being;

defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions; and computing a third set of values of said set of article dimensions from said first set of values of said first set of human body dimensions and said second set of values of said second set of human body dimensions by using said second mathematical model, wherein said second mathematical model embodies the experience of a skilled clothing designer or tailor.

18. A method for custom fitting an article to a human being comprising the steps of:

defining a first set of human body dimensions to be reported by the human being;

defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions;

computing a third set of values of said set of article dimensions from said first set of values of said first set of human body dimensions and said second set of values of said second set of human body dimensions by using said second mathematical model, wherein said set of article dimensions comprises garment waist, seat-waist differential, garment seat, seat shape, garment inseam, and bottom opening, wherein garment waist is computed from consumer-reported waist, and wherein if consumer-reported waist is less than 36 inches, then garment waist is consumer-reported waist plus 1 inch, and wherein if consumer-reported waist is greater than or equal to 36 inches then garment waist is consumer-reported waist plus 1 and ½ inches.

19. A method for custom fitting an article to a human being comprising the steps of:

defining a first set of human body dimensions to be reported by the human being;

defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions;

computing a third set of values of said set of article dimensions from said first set of values of said first set of human body dimensions and said second set of values of said second set of human body dimensions by using said second mathematical model, wherein said set of article dimensions comprises garment waist, seat-waist differential, garment seat, seat shape, garment inseam, and bottom opening, and wherein seat-waist differential is computed from seat and garment waist, and wherein seat-waist differential is ROUND(seat plus 4.5 inches) minus garment waist.

20. A method for custom fitting an article to a human being comprising the steps of:

defining a first set of human body dimensions to be reported by the human being;

defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions;

computing a third set of values of said set of article dimensions from said first set of values of said first set of human body dimensions and said second set of values of said second set of human body dimensions by using said second mathematical model, wherein said set of article dimensions comprises garment waist, seat-waist differential, garment seat, seat shape, garment inseam, and bottom opening, and wherein garment seat is computed from seat-waist differential, garment waist, seat, and consumer fit preference.

21. The method of claim 20, wherein if fit preference is "Little Room" then when seat-waist differential is less than 5 inches, garment seat is ROUND(garment waist plus 5 inches), when seat waist differential is greater than 11 inches, garment seat is ROUND(garment waist plus 11 inches), and when seat-waist differential is greater than or equal to 5 inches and less than or equal to 11 inches, garment seat is ROUND(seat plus 4 and ½ inches), wherein garment seat computed for fit preference of "Little Room" is defined as "Little Room Garment Seat", wherein if fit preference is "Close Fit" then when seat-waist differential is less than 6 inches, garment seat is ROUND(garment waist plus 5 inches), and when seat-waist differential is greater than or equal to 6 inches, garment seat is little room garment seat minus 1 inch, and wherein if fit preference is "Loose Fitting" then when seat-waist differential is greater than 9 inches, garment seat is ROUND(garment waist plus 11 inches), and when seat-waist differential is less than or equal to 9 inches, garment seat is little room garment seat plus 2 inches.

22. A method for custom fitting an article to a human being comprising the steps of:

defining a first set of human body dimensions to be reported by the human being;

defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions;

computing a third set of values of said set of article dimensions from said first set of values of said first set of human body dimensions and said second set of values of said second set of human body dimensions by using said second mathematical model, wherein said set of article dimensions comprises garment waist, seat-waist differential, garment seat, seat shape, garment inseam, and bottom opening, and wherein garment inseam is computed from consumer-reported inseam and consumer-reported rise.

23. The method of claim 22, wherein if consumer-reported rise is short, then garment inseam is consumer-reported inseam, wherein if consumer-reported rise is long, then garment inseam is consumer-reported inseam minus 1 inch, and wherein if consumer-reported rise is average, then garment inseam is consumer-reported inseam minus ½ inch.

24. A method for custom fitting an article to a human being comprising the steps of:

defining a first set of human body dimensions to be reported by the human being;

defining a second set of human body dimensions to be inferred from said first set of human body dimensions;

providing a first mathematical model relating said second set of human body dimensions to said first set of human body dimensions, wherein said mathematical model has been generated by statistical analysis of a human anthropometric database;

obtaining a first set of values of said first set of body dimensions by report of the human being;

computing a second set of values of said second set of human body dimensions from said first set of values of said first set of human body dimensions by using said first mathematical model;

defining a set of article dimensions;

providing a second mathematical model relating said article dimensions to said first set of human body dimensions and said second set of human body dimensions;

computing a third set of values of said set of article dimensions from said first set of values of said first set of human body dimensions and said second set of values of said second set of human body dimensions by using said second mathematical model, wherein said set of article dimensions comprises garment waist, seat-waist differential, garment seat, seat shape, garment inseam, and bottom opening, and wherein bottom opening is computed from consumer-reported fit preference and foot length.

25. The method of claim 24, wherein if fit preference is "Close Fit", then bottom opening is 3.14 times foot length times 0.50, wherein if fit preference is "Little Room", then bottom opening is 3.14 times foot length times 0.54, and wherein if fit preference is "Loose Fitting", then bottom opening is 3.14 times foot length times 0.57.

* * * * *